US006399018B1

(12) United States Patent
German et al.

(10) Patent No.: US 6,399,018 B1
(45) Date of Patent: Jun. 4, 2002

(54) POWDERED MATERIAL RAPID PRODUCTION TOOLING METHOD AND OBJECTS PRODUCED THEREFROM

(75) Inventors: Randall M. German, State College; Timothy J. Weaver, Bellefonte; Julian A. Thomas, Reedsville; Sundar V. Atre, State College, all of PA (US); Anthony Griffo, The Woodlands, TX (US)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 09/293,706

(22) Filed: Apr. 16, 1999

Related U.S. Application Data

(60) Provisional application No. 60/082,138, filed on Apr. 17, 1998.

(51) Int. Cl.[7] ..... B22F 7/00; C22C 1/05

(52) U.S. Cl. ..... 419/2; 75/236; 75/240; 75/244; 75/246; 75/252; 164/91; 164/97; 164/61; 164/66.1; 419/5; 419/13; 419/18; 419/27; 419/65; 428/545

(58) Field of Search ..... 428/545, 566, 428/567, 577, 648, 627, 642, 668, 671, 676, 677, 679, 682, 685; 51/295; 75/236, 240, 244, 246, 252; 164/91, 97, 61, 66.1; 419/2, 5, 13, 18, 27, 65

(56) References Cited

U.S. PATENT DOCUMENTS

| | | | | |
|---|---|---|---|---|
| 2,244,052 | A | * | 6/1941 | Comstock ..... 428/545 |
| 3,859,085 | A | | 1/1975 | Kimura et al. |
| 3,929,476 | A | | 12/1975 | Kirby, Jr. et al. |
| 3,992,199 | A | | 11/1976 | Neely |
| 4,024,902 | A | | 5/1977 | Baum |
| 4,073,999 | A | | 2/1978 | Bryan et al. |
| 4,123,265 | A | | 10/1978 | Takahashi et al. |
| 4,314,399 | A | | 2/1982 | Severinsson |
| 4,327,156 | A | * | 4/1982 | Dillon et al. ..... 428/545 |
| 4,455,354 | A | | 6/1984 | Dillon et al. |
| 4,554,218 | A | | 11/1985 | Gardner et al. |
| 4,617,053 | A | | 10/1986 | Joó et al. |
| 4,686,338 | A | | 8/1987 | Kashiwagi et al. |
| 4,710,223 | A | | 12/1987 | Matejczyk |
| 4,923,672 | A | | 5/1990 | Gladden et al. |
| 5,126,102 | A | | 6/1992 | Takahashi et al. |
| 5,269,989 | A | | 12/1993 | Pyzik |
| 5,507,336 | A | | 4/1996 | Tobin |
| 5,595,622 | A | | 1/1997 | Pyzik et al. |

OTHER PUBLICATIONS

R.M. German, "Prediction of a Sintered Density for Bimodal Powder Mixtures", Metallurgical Transactions A, vol. 23A, pp. 1455–1465 (1992).

Jau–ho Jean et al., "Liquid–phase sintering in the glass–cordierite system: particle size effect", Journal of Materials Science, vol. 27, No. 18, pp. 4967–4973 (1992).

* cited by examiner

*Primary Examiner*—Robert R. Koehler
(74) *Attorney, Agent, or Firm*—Ohlandt, Greeley, Ruggiero & Perle, L.L.P.

(57) ABSTRACT

Solid objects are made by means of a novel multi-step forming, debinding, sintering and infiltrating process, using a metal-ceramic composition. In this process, the mixture is held for a period of time to degas and settle the powdered material from a liquid binder. The packed geometry is then heated to above the melting temperature of the binder to remove the binder portion of the solid geometry. Upon removal of the binder the binder-free solid geometry is raised to a temperature where the metal pre-sinters together into a three-dimensional rigid matrix with interconnected porosity to form a solid precursor. The porous matrix includes the particulate ceramic material and a first metal, which are at least partially sintered. A molten second metal is then introduced to the fill the porous matrix and form an infiltrated matrix. In addition to speed of production, improvements associated with this method include a solid object having improved thermal conductivity, hardness, wear resistance and reduced shrinkage as compared with the rapid tooling techniques taught in the prior art.

40 Claims, 2 Drawing Sheets

POWDERED MATERIAL RAPID PRODUCTION TOOLING METHOD AND OBJECTS PRODUCED THEREFROM

CROSS-REFERENCE TO THE RELATED APPLICATION

This application claims priority from provisional patent application Serial No. 60/082,138, filed Apr. 17, 1998, titled RAPID PRODUCTION TOOLING VIA ADVANCED METAL PROCESSING.

FIELD OF THE INVENTION

The invention relates to a method of making products by infiltrating a porous, three-dimensional, interconnected structure with a molten metal, and the products produced therefrom.

BACKGROUND

The field of rapid tooling deals with methods to reduce the time required for producing a tooling component compared to traditional machining. Within this context, tooling or tools refer to mold cavities as well as machine elements used in manufacturing. Most injection molding, die-casting, stamping, and other industrial molding processes have high costs associated with tooling production. The field of rapid tooling has brought increased speed to producing prototype parts and molds, but has been unable to attain the high surface finishes, tolerances, and mechanical properties of their machined counterparts.

Ideally, manufacturers, engineers and tool builders would have a technique that could take them from a computer model to production tooling with a reduction in the number of steps. Such a technology could significantly reduce the time needed to get a new product to market, as well as drive the price of tooling down. It has been estimated in recent reports that total profits on new products are reduced by as much as 60% by the inability to get the product to market quickly. Implicitly, the cost savings of such a method have the ability to go beyond simply the cost of tooling production having considerable impact on new product success and profit potential. Any savings in time will greatly improve the profit potential of industries such as fashion, automotive, toy, cosmetics and consumer electronics, which produce products that are time sensitive. Previous attempts to produce tooling using powdered metals have had problems with speed of production and final properties such as thermal conductivity, hardness, surface finish, porosity, wear resistance, and dimensional precision. Tooling is traditionally produced by machining with extremely expensive equipment. This approach utilizes highly qualified personnel, typically requiring up to 14 weeks to produce a quality tool. The purpose of the present invention, therefore, is to enable industry to make production grade tooling for a wide variety of manufacturing techniques in a short amount of time with minimal investment in equipment. The significance of the present invention lies in the fact that the expenses, time, and equipment investments are much less than prior art methods.

Current methods of tool production include the machining of steel or tool steel stock (or other non-ferrous based metals available in block shapes), epoxy (filled and un-filled) molds, nickel spray formed molds, several varieties of powdered metal rapid tooling, and molds containing metals, cermets or ceramic compounds. For example, U.S. Pat. Nos. 3,929,476, 4,073,999, 4,314,399, 4,327,156, 4,455,354, 4,491,558, and 5,507,336 generally describe the use of ceramic, carbide, and metal powders including but not limited to tungsten carbide, steels, tool steels and stainless steels. The conventional methods described in the prior art have been limited by their inability to produce near net complex shapes.

U.S. Pat. No. 4,024,902 to Baum, for example, the teachings of which are herein incorporated by reference, describes composites consisting of sintered tungsten carbide agglomerates in a matrix of steel alloy. However, this reference is directed to adding a molten steel alloy that dissolves the tungsten carbide material. Accordingly, the process is not well suited for the production of precision molded articles.

Similarly, U.S. Pat. No. 4,554,218 to Gardner et al., the teachings of which are also incorporated by reference, describes an infiltrated metal composite article comprising multiple metal powders. However, this reference describes sinterable metal powders without describing such powders in combination with a particulate ceramic material such as sintered tungsten carbide agglomerates. Such a particulate ceramic material can help improve the hardness and wear properties in the final part. Additionally, the advantage of using specific volume fractions of the constituents to form a rigid, percolated microstructure with interconnected phases is not exploited in these systems.

A percolated microstructure implies that there is a communication across the structure, such as thermal or electrical conductivity, resulting from interconnected phases. For powder processing, the percolation limit, which is defined as the amount below which communication across the structure is interrupted, is above approximately 16 volume percent of a phase in mixed powders. Therefore, when a structure contains a component in amounts less than approximately 16 volume percent, a percolated phase for that component is not formed.

Gardner describes less than 15 volume percent of a relatively soft refractory phase (preferably tungsten) that is encapsulated by a sinterable hard phase (preferably tool steel). Such encapsulation, coupled with less than 15 volume percent of the refractory phase, does not allow the formation of an interconnected, percolated microstructure, but leads to the formation of discrete "islands" in the microstructure.

Furthermore, the method described by Gardner requires the mechanism of volume diffusion during sintering. Bonding via volume diffusion can be recognized by a change in shape of the sintering particle surface, which can provide distortion in an object fabricated by the process. This is in contrast to the bonding mechanism of surface diffusion during sintering which is characterized by a lack of change in the shape of the sintering particle surface.

A need exists for a process and an object that can overcome the problems of shrinkage and distortion traditionally associated with forming large is objects with intricate shapes via powdered metals. In particular, the possibility of achieving low temperature sinter bonding of powders in the absence of volume diffusion can provide an important route to minimizing distortion in the metal object. At the same time, the process should also be capable of resulting in an object that possess the mechanical properties desirable in production tooling at greatly reduced times compared to traditional methods. Accordingly, the inventors have developed a method that provides improvements in the combination of speed of production, and production of high quality, multiple molds or parts from a single prototype. These improvements are achieved by a combination of the method and the composition contained herein.

SUMMARY OF THE INVENTION

The current invention achieves the end goal of producing metallic objects by means of a novel multi-step forming, debinding, sintering and infiltrating process, using a metal-ceramic composition. Metallic object or metallic tool is understood to mean a metal-based object or tool such as a cermet. Additionally, a metallic tool further encompasses a die and a mold. The term particulate ceramic material is understood to mean monolithic ceramic powders, cermets, agglomerated ceramic powders, ceramic powders bonded together with metallic or non-metallic constituents, mixtures of these components or sintered compositions comprising of any of these materials.

To make such metallic objects with the present process, a mixture comprising a binder, a powdered first metal and particulate ceramic material is used. In one embodiment of the invention, the sintered, bonded granular ceramic is composed of a material selected from the group consisting of: silicon carbide, boron nitride, and tungsten carbide. In another embodiment of the invention the bonding material is a sintering activator for the particulate ceramic or cermet material. In a further embodiment of the invention, the particle sizes of the powdered first metal and the particulate ceramic or cermet material are in a multi-modal distribution in the ratio from greater than 1:1 to about 1:10. In a preferred embodiment of the invention, the particle sizes of the powdered first metal and the powdered ceramic are in a bi-modal distribution in the ratio of about 1:7, respectively.

In one embodiment of the invention, the volume % of the particulate ceramic or cermet material is in the range from 20% to 50% of the total volume of the powdered first metal and the particulate ceramic or cermet material. Once this mixture is heated and molten it is cast under vacuum into a silicone rubber mold to form the desired geometry. The mixture is held under vacuum for a period of time to degas the mixture, which is then cooled and solidified. The solid geometry is then removed from the silicone rubber mold and transported and packed into an alumina powder bed and placed into a furnace. The packed geometry is then heated to above the melting temperature of the binder to remove the binder portion of the solid geometry. Upon removal of the binder the binder-free solid geometry is raised to a temperature where the first metal begins to form sinter bonds in a three-dimensional rigid matrix with interconnected porosity to form a solid precursor. The porous matrix includes the particulate ceramic material and the first metal, which are at least partially sintered. A molten second metal is then introduced to the porous matrix such that the molten second metal infiltrates the interconnected porosity of the porous matrix to form an infiltrated matrix. Finally, the infiltrated matrix is cooled to form a solid object, which is comprised of interconnected networks of the solidified second metal, at least partially sintered first metal and the rigid matrix of the particulate ceramic material. In one embodiment of the invention, the solid object has wear of at most 0.1 $cm^3$ material removed as per ASTM G65, Procedure A: a hardness of at lest 20 HRC; an impact stregth of at lease 4 $j/cm^2$; and a travel rupture streght of at least 700 MPa. Improvements associated with the composition are observed with properties such as thermal conductivity, hardness, surface finish, porosity, and reduced shrinkage from original prototype part as compared with the rapid tooling techniques taught in the prior art.

Because the present method is non-destructive to the original model, feasibly it is more competitive than metal casting or conventional rapid tooling processes since it allows multiple molds to be made from one master part.

DETAILED DESCRIPTION OF THE INVENTION

The present multi-step processing technique, coupled with a unique blend of starting materials, results in vastly improved attributes of the finished metallic object compared to the teachings of the prior art. Distinguishing features of the present invention are described below:

a) A coarse particulate ceramic material is used in the starting mixture of powders and binder and constitutes the hard phase in the final metal object. One example of such a material is agglomerates of tungsten carbide particles bonded with 6 to 10 wt. % cobalt and sinter-densified prior to use in the processing mixture. Since the agglomerates of the ceramic-metal composite have already been sintered prior to incorporation in the metal object, they themselves undergo negligible change in dimensions during the subsequent thermal processing stages. These hard particles are used at a concentration above the percolation limit (>16 vol. %) to create a rigid, point contact network which prevents the fabricated component from distorting during the forming process.

Figure 1:
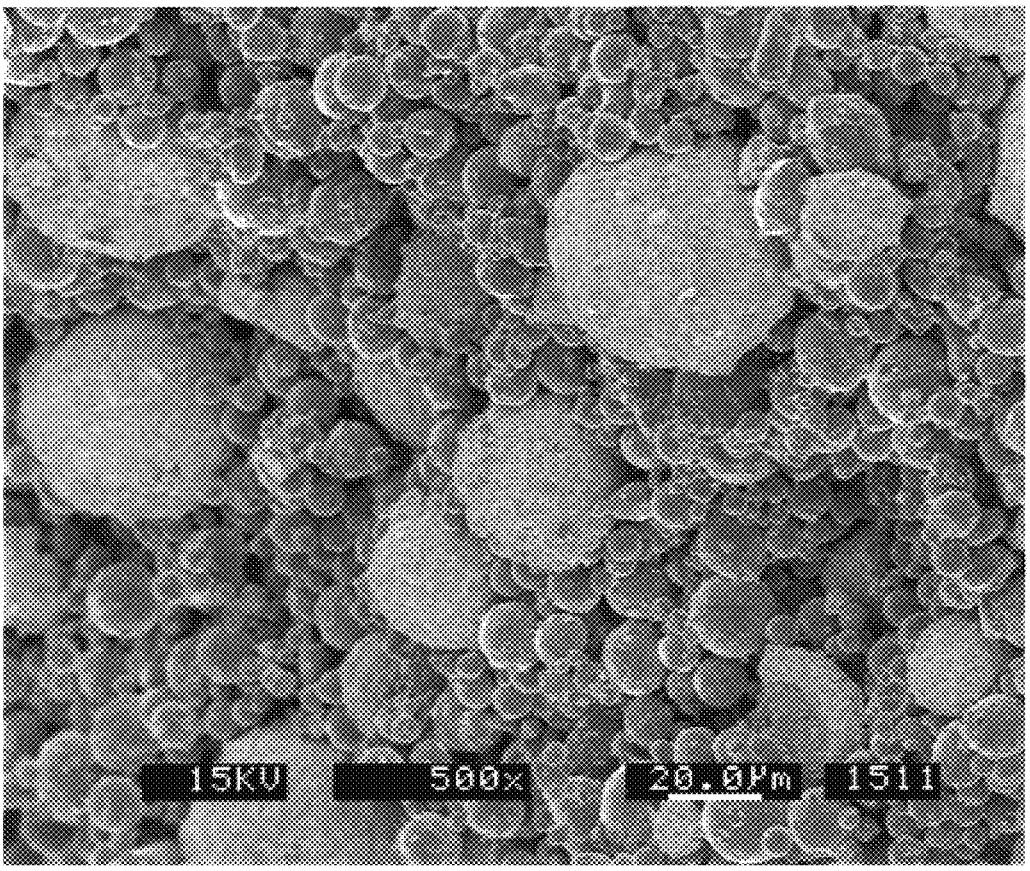
FIG. 1 shows a microstructure of the fracture surface of a pre-infiltrated, porous, three-dimensional rigid matrix comprised of a particulate ceramic material and partially sintered powders of the first metal with interconnected porosity [Magnification: 500×].

In general, the inclusion phase should consist of coarse particles that are stable at least until the maximum processing temperature. Further, the coarse particles should not dissolve in the other constituents of the composite. The coarse particles inhibit the densification (shrinkage) but do not inhibit sinter bonding of the powdered first metal.

b) The initial processing mixture also includes a fine metal powder that is used in combination with the above-mentioned coarse particulate ceramic material. The fine metal powder is capable of undergoing sinter bonding at a relatively low temperature and allows the coarser particulate ceramic material to remain physically and chemically stable. The coarser particulate ceramic material does not necessarily need to be affected by either the processing environment or the first metal, but can be sinter bonded to the fine metal powder at the same temperature at which the finer particles bond to each other. As a result, a second level of inter-linked structure is formed from these small particles that sinter to the hard skeleton. A preferred material in the present invention is a stainless steel, which can undergo appreciable sinter bonding at relatively low temperatures such that negligible volume diffusion occurs.

c) Ideal powders are those that pack to densities above 70 to 90 volume percent of theoretical density in the powder binder mixture. Here, it was discovered that the use of fine metal powders and coarse particulate ceramic material in an average size ratio ranging from 1:7 to 1:10 and a volume ratio of 1:1 to 4:1, respectively, creates favorable conditions for maximum solids loading. It was further discovered that these compositions provided a rigid interconnected network of coarse particles to allow sinter bonding of the structure with minimal shrinkage. See FIG. 1.

An additional desirable feature in the present invention is that the powders provide the mechanical properties required in the combined sintered and infiltrated final form to be used in production tooling. As an example, a blend of stainless steel and sintered cobalt bonded tungsten carbide agglomerated powders provide the best combination of packing and mechanical properties for use in this invention. Stainless steel is also attractive if corrosion resistance of the final part is desired.

d) The solids loading in the initial process mixture is maximized by settling the powders in a low viscosity liquid binder and under vacuum, which is then cooled in the rubber mold after settling to form a highly powder-loaded part. This processing step, in combination with the compositional advance described above (a-c), contributes to the very low final shrinkage in the final part, less than 2%, and preferentially, less than 0.5%.

In addition, the unique ability of the method to capture the detail of the master part is related to the inherent flow characteristics associated with the present molten mixtures that conform to the shape of the mold. To achieve maximum settling of the powdered raw material in the filled cavity, the binder should exhibit a viscosity of less than approximately 10 Pa.s for a period of time that allows complete settling to occur. This viscosity can be achieved by using, alone or in combination, a wax such as paraffin wax or a thermoplastic polymer such as polypropylene or polyethylene thermoplastic to create the liquid part of the slurry.

The mixture of powder, wax, and polymers can be formed at any ratio from 40% powder to 80% powder by volume, with the balance being the thermoplastic polymers and wax. The slurry generally should have a low viscosity and preferably should be capable of being stirred to obtain a homogeneous mixture before pouring into the cavity. The completion of this step under vacuum with the final cooling stage taking place at atmospheric pressure allows for very few if any remaining pores, allowing for the highest possible solids loading without pressure being applied.

e) A combination of wicking and thermal decomposition is used to eliminate the organic binder from the object. While the binder may be removed by another process such as solvent treatment, this step is preferably performed by using a wicking bed of fine ceramic powder. The wicking powder can be a variety of materials, including fine ceramic powders of zirconia, alumina, silicon carbide, and tungsten carbide. The particle size of the ceramic powder should be fine enough to wick the polymer/wax out of the final part and the ceramic powder should not sinter at the highest process temperature (1100° C.). The size range of the wicking powder should be smaller than the powder in the part, as the flow of the binder will move preferentially toward areas of finer capillaries (spaces between the powders). Following packing, the part is heated above the removal temperature of the binder, defined as the melting, sublimation or decomposition point of the binder. Here, the capillary forces created by the spaces between the wicking powder draws the polymers out of the part. The heating process generally takes from 0.3 hours to 24 hours depending on the final part size.

To aid in the removal of the binder and contribute to the dimensional stability of the part during sintering, wicking powder is uniaxially packed around the part. Because the powder holds the component tightly in place during the thermal debinding phase, it acts as a support and as a wicking medium to remove the binder by capillary extraction during a thermal cycle in a furnace. Optimal packing is accomplished by at least one, and preferably a series of uniaxial tapping steps. Tapping is repeated until the wicking powder no longer continues to compact into the container. At this point, maximum interlocking between particles occurs, providing a stable support for the component. This technique allows a single-phase binder system to be used, if necessary, to achieve the low viscosity fluid described in (c).

f) After wicking, the temperature in the furnace is further increased to partially fuse the powders together, in a stage called presintering. The resulting bonds contribute to the mechanical strength in the final part. Upon sintering, the coarse particles remain locked together due to the tight particle packing, while the small particles create the necessary sinter bonds to maintain sufficient rigidity to prevent distortion when the liquid metal infiltrant is added. The two constituent phases are inter-twined in the resulting microstructure in the present invention. See FIG. 1. The first phase in the present invention consists of hard, coarse agglomerates of particulate ceramic material. Further, the present invention uses the mechanism of surface diffusion to allow the particles to adequately sinter bond.

g) After the presintering step, the final part has very tiny pores (holes) with an interconnected network created by bonds at the particle-to-particle contacts. To produce a completely dense or solid part these pores need to be filled. The density of the part can be measured and compared to the theoretical density of the powder mixture used to form the final part to yield the amount of pore or void space left by the removal of the waxes and polymers. The amount of infiltrant material required can be calculated by converting the volume of void space into a weight. The infiltrant provides properties not achieved by the presintered particles alone and thus create a unique composite material that exhibits the beneficial properties of the combination of materials in a nearly fully dense part. Pre-weighed infiltrant material (e.g., bronze, copper, nickel, iron, tin, bismuth, alloys or mixtures thereof, optionally doped with components such as boron, phosphorus and lithium) may be introduced into the porous, three-dimensional matrix in the following manner. Powdered infiltrant material is pressed into pellets, plugs or any other desired shape, and contacted with the porous part, usually on the back face of the final part or tool mold. The part is then placed back into the furnace with the infiltrant material in contact with a non-critical surface. The furnace is next heated above the melting point of the infiltrant and the molten infiltrant material is wicked into the pore or void space like a sponge absorbs water. After a time sufficient to allow the pores to be filled, which could vary from minutes to hours depending on the part thickness, an infiltrated and fully dense final part is formed. An important feature in the present invention is the selection of fine metal powders that do not undergo volume diffusion controlled sintering shrinkage at the infiltration temperatures. Further, the present invention allows the infiltrant to wet the first metal with no detriment to its sinter bonds.

Figure 2:
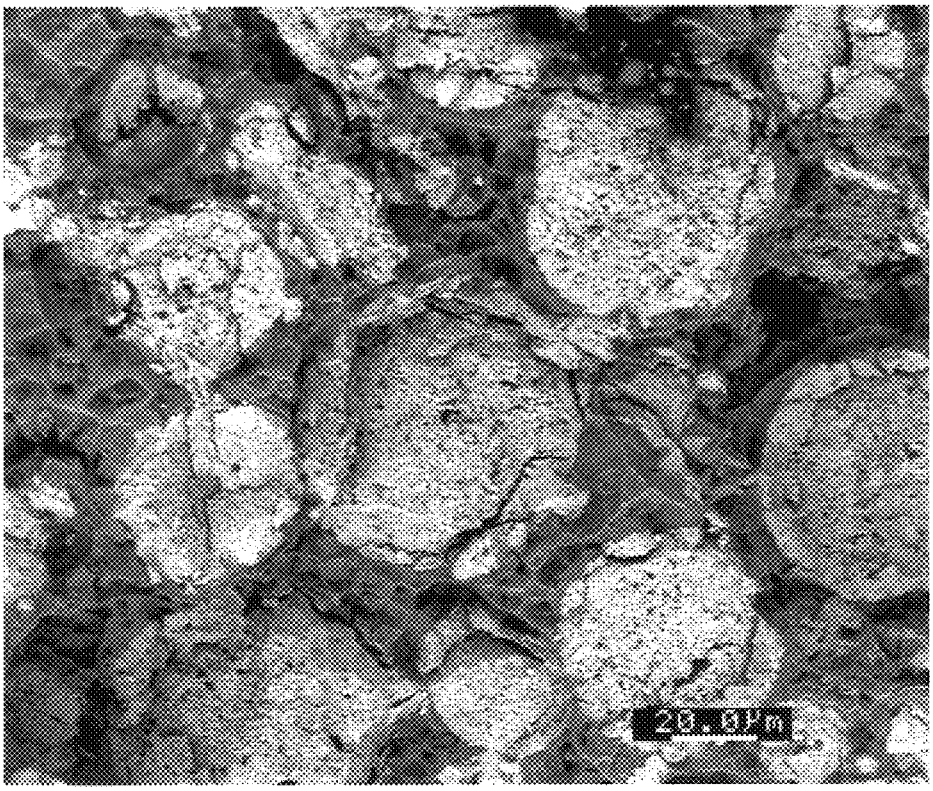
FIG. 2 shows a microstructure of the fracture surface of an object consisting of a three-dimensional rigid matrix of a particulate ceramic material and partially sintered powders of the first metal intertwined with a solidified infiltrated second metal [Magnification: 500×].

The present invention has unique physical and mechanical properties because it has three interconnected structures with different designed functions. The first is the percolated structure of the particulate ceramic material compact which makes the solid precursor rigid, thereby reducing shrinkage and providing hardness. The second is the presintered fine metal powder, which bonds providing mechanical integrity. Finally the third structure, is the infiltrated second metal matrix, which eliminates the remaining porosity and binds the presintered structure together. See FIG. 2.

The following is meant to illustrate but not limit the invention. In particular, it generally describes the novel method discovered by the inventors.

An original master part is made in the exact shape of the part or the mold by utilizing a 3-dimensional additive process fabricator. A preliminary mold is produced in the complementary shape of the master part by coating the master part with a high hardness, high quality rubber, which is subsequently solidified. The rubber is vacuum degassed prior to forming the rubber mold to eliminate all possible bubbles.

Next, a mixture of fine metal powder and particulate ceramic material is blended together with a binder in a heated mixing vessel to form a slurry. The powder blend is mixed at a ratio of approximately 55% powder by volume with the remaining volume being the binder. After heating the mixture to form a slurry with low viscosity, the mixture is poured into the rubber mold, which has been pre-heated to just above the melting temperature of the binder.

With the molten mixture in the rubber mold, the mold is placed into a pre-heated vacuum oven for degassing above the melting temperature of the binder for a time long enough for the vacuum level to be below 28 inches of mercury for 1 to 20 minutes.

The vacuum level is raised to atmospheric pressure, and the mold is removed from the heated vacuum chamber, with the mixture still molten. The powder and binder are allowed to settle, leaving a thin binder layer on the top. After completely cooling to room temperature, the binder-powder precursor is removed from the rubber mold, and the excess binder layer is scraped off with a flat blade or by machining.

The binder-powder component is then prepared for debinding and sintering. A rigid metal vessel containing the part or mold is filled slowly with submicron alumina powder while being uniaxially tapped to pack the powder tightly around the part or mold. The bowl is then completely filled with the alumina powder in the same manner. There is generally about 1–2 inches of powder in all directions of the part such that the total amount of powder is approximately 1 to 10 times the volume of the precursor.

The vessel packed with powder and the part or mold is then placed into a furnace capable of producing a predominantly hydrogen atmosphere and ramp rate control up to a minimum of 1200° C. The temperature is increased to a point between the melting point and the boiling point of the binder (approximately 120° C.) at a ramp rate of approximately 1–2° C. per minute. The furnace normally remains at this temperature for about one hour at which time the temperature is raised at a rate of 2–3° C. per minute, to a temperature of 1100° C. for one hour. The furnace is then allowed to air cool.

Once the furnace is cool, the part is removed and thoroughly brushed and blown off with compressed air to remove any of the alumina powder. An amount of the infiltration powder (preferentially bronze) is then weighed to match the remaining volume of porosity in the part. This powder metal is then pressed into blocks or pellets of specific weights to allow for even distribution over one or more surfaces of the component. The pressed infiltration pellets are then placed onto the back of the part.

The vessel containing the pellets and part are next placed into a furnace and taken approximately 10–40° C. above the liquidus of the infiltrant, in a hydrogen-containing atmosphere to allow the metal to infiltrate the porous matrix. After a time sufficient to allow the metal to completely infiltrate the porous matrix, the fully dense part is cooled to room temperature. The dimensional difference between the final solid part and the cavity is less than approximately 2%, preferentially less than 0.5%.

Example 1, which is an actual example of the invention, demonstrates that the particulate ceramic material, which should be hard and wear resistant, acts as a barrier to abrasive wear during use, and results in excellent mechanical properties.

EXAMPLE 1

Stainless steel powder (17-4PH, <22 μm,) was mixed with coarse sintered cobalt bonded tungsten carbide agglomerates (~150 μm) to achieve a mixture of 60% stainless steel, 40% tungsten carbide (vol/vol). This difference in particle size achieves a particle size ratio of about 1:7. This powder blend was then mixed with a wax to create a low viscosity slurry at moderate temperature (<200° C.). The slurry was poured into a negative mold made of silicone rubber. After evacuation at molten temperature to remove air bubbles and subsequent release of vacuum, the mold/slurry was cooled to room temperature. The component was then removed from the mold and packed in fine alumina powder (less than 5 μm), which acted as a support structure during the wicking of the wax.

The packing process consisted of placing the wicking powder into a rigid metal container, tapping the container to pack this powder to form a base on which to place the component (approximately one part thickness). The component was then pressed into this base of powder after which additional powder was added to cover the component with approximately one part thickness. The entire container with the contents was placed onto a specially made device that repeatedly lifts and drops a heavy metal table, causing the powder within the container to become tightly compacted, thus immobilizing the component. The container with the wicking powder and the molded object was placed in a furnace, which was then purged with nitrogen.

After purging for the equivalent of two to three chamber volumes to remove the majority of the air, the gas was changed to hydrogen at a rate of 10 chamber volumes per hour. An initial heating rate of 2° C./min. was used up to the first hold at 125° C. (actual part temperature). The temperature was held for sufficient time to allow the wax to liquefy and wick into the alumina powder. In this case, the temperature was maintained for two hours. Following this hold, the temperature was raised at a rate of 2° C./min. to 325° C. This temperature was held for two hours until the wax had been vaporized and removed by the flowing hydrogen atmosphere. Prior testing indicates that the combustion of the wax used begins at 200° C. and is completely combusted by 300° C. in air. To ensure removal of all the wax in hydrogen, the temperature was again raised at a rate of 2° C./min. to 475° C. for two hours. After complete removal of the wax, the temperature was raised at a rate of 3° C./min. to 1025° C. to cause initial sinter bonds to form between the stainless steel particles. This light bonding allows for sufficient handling strength to remove the part from the wicking bed, and prepare it for infiltration by a second thermal cycle. After a one hour hold, the furnace was allowed to cool to ambient.

After cooling, the component was approximately 30% porosity, 42% stainless steel, 28% bonded tungsten carbide agglomerates. This density was obtained by weighing the part before and after thermal processing. The loss in weight can be used to calculate the % binder present in the component prior to thermal processing, and thus the fractional pore space in the presintered component (after a correction for any measured shrinkage from original dimensions). Theoretical densities of each powder were measured using a helium pycnometer. The mass in grams of infiltrant used was obtained by multiplying the measured density (g/cm$^3$) of the infiltrant by the pore volume (cm$^3$).

The presintered component was then infiltrated with bronze to fill the remaining porosity. To achieve complete infiltration, the part was cleaned on the back surface and pressed powder pellets of infiltration grade bronze were placed on this pre-cleaned surface only. This assembly was placed in an alumina powder bed, taking care not to allow any alumina to contact the cleaned upper surface of the component. The alumina acts as a barrier to the infiltrant wetting the part, and is therefore allowed to contact all surfaces except the one where the pellets are placed. This arrangement prevents over saturation and subsequent pooling of infiltrant on the more critical surfaces. This assembly was then placed into the same furnace described above, purged with nitrogen and then hydrogen at a rate of 10 chamber volumes per hour. The temperature was raised at a rate of 5° C./min. to 1025° C. This allowed the infiltrant to melt and fill the network of capillaries remaining in the component. After a one hour hold and subsequent cooling, the final product was a composite of stainless-steel, hard phase and metal infiltrant. This material showed improved wear characteristics over standard steel-copper materials produced by other rapid tooling technology with hardness values comparable to some wrought tool steels. The mechanical properties of a tool made according to the above example are given in Table I.

TABLE I

| Mechanical Property | Recorded Value |
|---|---|
| Strength (transverse rupture) | 1150 MPa |
| Hardness (Rockwell Hardness scale C) | 35 to 40 HRC |
| Impact Strength | 8–10 J/cm$^2$ |
| Wear Resistance (ASTM G65 Procedure A) | 0.052 cm$^3$ material removed (hardened D2 tool steel 0.059 cm$^3$) |
| Surface Roughness | 1.5 to 2 $\mu$m average roughness |
| Surface Roughness (after polishing) | 0.15–0.2 $\mu$m (polished tool steel ~0.2 $\mu$m) |
| Shrinkage | ~0.4% |

In the foregoing detailed description reference has been made to preferred embodiments of the invention. It will be obvious that variations may be made thereto without departing from the spirit or the scope of the general invention as defined by the appended claims and their equivalents.

We claim:

1. A method for making a solid object, said method comprising the steps of:

a) forming a liquid mixture with a composition comprising a binder, a powdered first metal, and a particulate ceramic or cermet material by maintaining the temperature of said mixture above the melting temperature of said binder;

b) filling a cavity having the shape of said solid object with said liquid mixture;

c) degassing said liquid mixture;

d) maintaining the temperature of said degassed liquid mixture in said cavity above the melting temperature of said binder to partially separate by settling said first metal and said particulate ceramic or cermet material from said binder, and cooling to form a solid precursor;

e) removing said solid precursor from said cavity;

f) increasing the temperature of said solid precursor to form a porous, three dimensional rigid matrix with interconnected porosity, said porous matrix being comprised of said ceramic or cermet material and, at least partially sintered said first metal;

g) introducing a molten second metal to said porous matrix such that said molten second metal infiltrates the interconnected porosity of said porous matrix to form an infiltrated matrix; and h) cooling said infiltrated matrix to form said solid object, said solid object comprising solidified said second metal, at least partially sintered said first metal and a rigid matrix of said ceramic or cermet material.

2. The method of claim 1, wherein said step of degassing said liquid mixture comprises heating the liquid mixture filled cavity for a time and temperature sufficient to degas said mixture.

3. The method of claim 1, wherein said cavity is a complementary image of a three-dimensional object made by covering said object with a liquid polymer or polymer precursor, rendering said liquid into a solid and then removing the solid polymer from said object.

4. The method of claim 1, wherein the step of introducing said molten second metal to said porous matrix comprises the steps of heating said porous matrix to at least the melting temperature of said second metal and contacting the molten second metal with said porous matrix.

5. The method of claim 1, wherein said binder is liquid or pourable.

6. The method of claim 1, wherein said binder is meltable.

7. The method of claim 1, wherein said binder comprises a molten thermoplastic polymer.

8. The method of claim 7, wherein said binder comprises a thermoplastic polymer having a viscosity less than or equal to about 10 Pa-s in the molten state.

9. The method of claim 1, wherein said particulate ceramic or cermet material comprises a sintered, bonded granular ceramic material.

10. The method of claim 9, wherein said powdered first metal and said sintered, bonded granular ceramic material are heated and mixed under vacuum with said binder at a temperature sufficient to melt said binder and degas said mixture.

11. The method of claim 1, wherein said degassed liquid mixture is removed from vacuum and allowed to settle while above the melting point of said binder, thereby forming a settled mixture.

12. The method of claim 11, wherein said settled mixture has a packing density in the range of from 70%–90% of theoretical density.

13. The method of claim 1, wherein said liquid mixture has a solids loading level of at least 55 volume %.

14. The method of claim 1, wherein the step of removing said binder from said solid precursor includes: removing said solid precursor from said cavity, packing solid precursor in a ceramic powder to form a packed object, heating said packed object below the sintering temperature of said ceramic powder but above the melting temperature of said binder, said ceramic powder having a particle size which is selected to absorb said binder from said packed object into said ceramic powder.

15. The method of claim 14, wherein said ceramic powder forms interconnected porosity with a pore size that creates capillary forces causing said binder in the packed object to move into said ceramic powder when said packed object is heated above the melting point of said binder.

16. The method of claim 14, wherein said ceramic powder is a zirconia, an alumina, a tungsten carbide, or a silicon carbide.

17. The method of claim 14, wherein heating of said packed object occurs in a hydrogen-containing atmosphere.

18. The method of claim 14, wherein the volume of said ceramic powder in said packed object is about 1 to 10 times the volume of said solid precursor.

19. The method of claim 1, wherein said second metal melts at a temperature below the temperature of step f).

20. The method of claim 19, wherein said second metal has wetting properties, in the molten state, such that said molten second metal infiltrates the pores of said three dimensional rigid matrix without the application of pressure.

21. The method of claim 19, including the step of infiltrating the pores of said three dimensional rigid matrix by applying pressure to said molten second metal.

22. The method of claim 19, wherein said second metal comprises: copper, nickel, iron, tin, bismuth, alloys of these metals, mixtures of these metals, or bronze.

23. The method of claim 22, wherein said second metal includes a addition s of boron, phosphorus, or lithium.

24. The method of claim 1, wherein at least one of steps (d) to (g) is carried out in a hydrogen containing atmosphere.

25. The method of claim 1, wherein said solid object is a tool or die.

26. The method of claim 1, wherein the dimensional d difference between said solid object and said cavity is less than approximately 2%.

27. The method of claim 14, wherein packing said solid precursor in said ceramic powder includes at least one uniaxial tapping step.

28. A composition for making a metallic object, said composition comprising:

a) a powdered first metal;

b) a particulate ceramic or cermet material containing a bonding material; and c) a binder, wherein said composition is capable of forming a dimensionally stable, interconnected, porous matrix that can b e filled with a molten infiltrant material.

29. The composition of claim 28, wherein said powdered first metal has a sintering temperature between the solidus temperature of said molten infiltrant material and the sintering temperature of said particulate ceramic or cermet material.

30. The composition of claim 28, wherein said first powdered metal is a stainless steel.

31. The composition of claim 28, wherein said particulate ceramic or cermet material consists essentially of a sintered, bonded granular ceramic that has a sintering temperature above the sintering temperature of said powdered first metal.

32. The composition of claim 31, wherein said sintered, bonded granular ceramic is composed of a material selected from the group consisting of: silicon carbide, boron nitride, and tungsten carbide.

33. The composition of claim 28, wherein said bonding material is a sintering activator for said particulate ceramic or cermet material.

34. The composition of claim 28, wherein said bonding material consists essentially of cobalt.

35. The composition of claim 28, wherein said binder has a viscosity below 10 Pa-s in the molten state, said binder further having a removal temperature below the solidus of said molten infiltrant material.

36. The composition of claim 28, wherein said composition comprises from 40% to 80% by volume of said powdered first metal, said particulate ceramic or cermet material, or mixtures thereof.

37. The composition of claim 28, wherein particle sizes of said powdered first metal and said particulate ceramic or cermet material are in a multi-modal distribution in the ratio from greater than 1:1 to about 1:10.

38. The composition of claim 37, wherein particle sizes of said powdered first metal and said powdered ceramic are in a bi-modal distribution in the ratio of about 1:7, respectively.

39. The composition of claim 28, wherein the volume % of the particulate ceramic or cermet material is in the range from 20% to 50% of the total volume of said powdered first metal and said particulate ceramic or cermet material.

40. The composition of claim 39, wherein said powdered first metal and said particulate ceramic or cermet material have a loading level of 60 volume % and 40 volume %, respectively.

* * * * *